United States Patent [19]

Therrien

[11] Patent Number: 5,022,518

[45] Date of Patent: Jun. 11, 1991

[54] STORAGE CONTAINER FOR PRECIOUS COINS, MEDALS, BARS AND SIMILAR PIECES

[76] Inventor: Norman W. Therrien, P.O. Box 83, Dalton, Mass. 01226

[21] Appl. No.: 513,627

[22] Filed: Apr. 24, 1990

[51] Int. Cl.[5] ..... B65D 85/62; B65D 8/04; A45C 1/00

[52] U.S. Cl. ..... 206/0.82

[58] Field of Search ..... 206/0.8, 0.81, 0.82, 206/0.83, 0.84, 267

[56] References Cited

U.S. PATENT DOCUMENTS 4,183,432 1/1980 Lemaire ..... 206/0.82
4,715,492 12/1987 Holmes ..... 206/0.82

FOREIGN PATENT DOCUMENTS 637141 3/1962 Italy ..... 206/0.82

*Primary Examiner*—William I. Price
*Attorney, Agent, or Firm*—Leon Gilden

[57] ABSTRACT

An injection molded storage container for precious pieces is of an airtight construction and includes individual holding slots for the pieces. The slots are defined by trapezoidally-shaped separators which prevent the pieces from touching each other, while only the rims of the pieces actually come into contact with the separators. A locking arrangement is provided for securing the storage containers in a closed position, and the containers are further designed to absorb substantial shocks which otherwise could result in damage to the precious pieces stored therein.

3 Claims, 6 Drawing Sheets

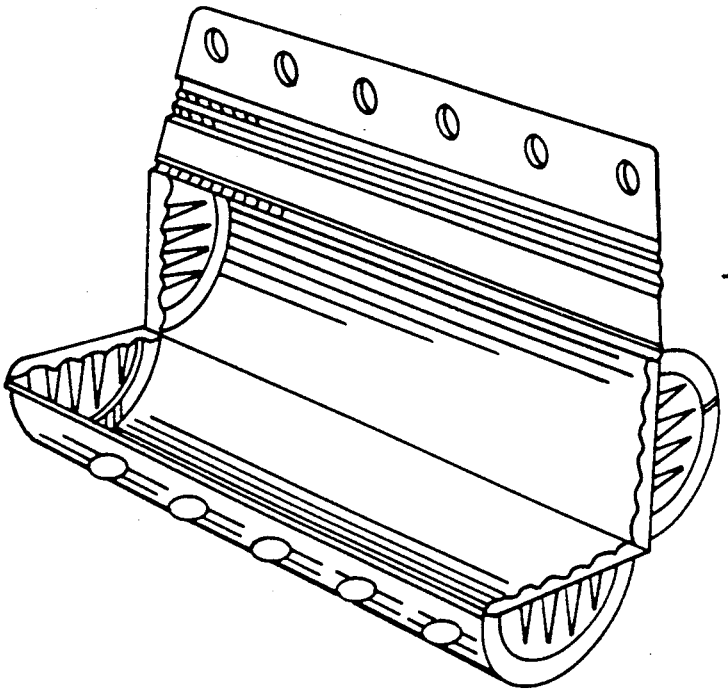
Fig 1
PRIOR ART
Fig 2
PRIOR ART
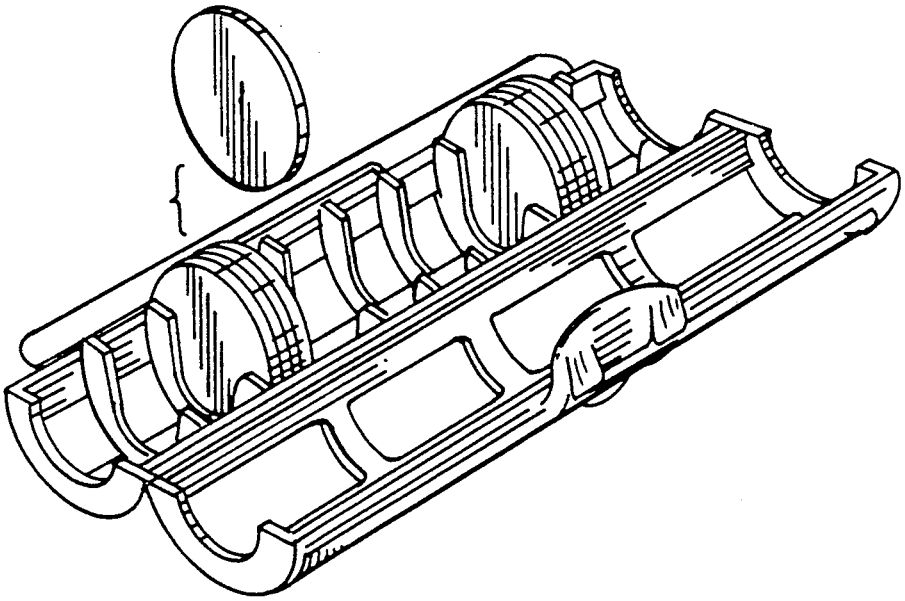

STORAGE CONTAINER FOR PRECIOUS COINS, MEDALS, BARS AND SIMILAR PIECES

BACKGROUND OF THE INVENTION

1. Field of the Invention

The present invention relates to holders for precious items, and more particularly pertains to a new and improved storage container for precious coins, medals, bars and the like.

2. Description of the Prior Art

The use of storage containers for precious items, such as coins and the like, is known in the prior art. More specifically, precious item storage containers heretofore devised and utilized for the purpose of storing coins, medals, bars, and the like are known to consist basically of familiar, expected and obvious structural configurations, notwithstanding the myriad of designs encompassed by the crowded prior art which have been developed for the fulfillment of countless objectives and requirements.

In this respect, the prior patent art is replete with examples of storage containers for precious items—especially where such items are in the form of coins. Typical examples of patents relating to coin storage containers are U.S. Pat. No. 1,139,604 which issued to F. Vogel on May 18, 1915 and which is directed to a "Coin Tube and Tray"; U.S. Pat. No. 2,643,762 which issued to H. Neilsen on June 30, 1953 and which is directed to a "Coin Container"; U.S. Pat. No. 4,139,093 which issued to G. Holmes and which is directed to a "Hinged Holder for Disc-Like Objects"; U.S. Pat. No. 4,183,432 which issued to R. Lemaire on Jan. 15, 1980 and which is directed to a "Transparent Container for Holding a Predetermined Quantity of Coins"; U.S. Pat. No. 4,240,544 which issued to Barnhart et al on Dec. 23, 1980 and which is directed to a "Coin Holder"; and U.S. Pat. No. 4,541,528 which issued to G. Holmes on Sept. 17, 1985 and which is directed to a "Hinged Coin Holder".

All of the coin holders described in the above-listed patents are functional for their intended purposes but are not particularly well suited for use in the storage and protection of precious coins and the like. In this regard, none of the described coin containers substantially prevent the individual coins from touching each other, while with respect to the ones utilizing separators for the coins, the separators per se are not designed to touch the coins only along the rims thereof. Further, these prior art coin containers do not facilitate accurate accountability of the coins contained therein, nor are they designed to hold coins of various diameters and thicknesses. At least some of these containers are not designed to prevent rolling or to absorb substantial shock which otherwise could result in damage to precious pieces stored within the containers.

Therefore, it can be appreciated that there exists a continuing need for new and improved precious item storage containers which can be utilized to safely store and protect precious coins, medals, bars and similar items. In this regard, the present invention substantially fulfills this need.

SUMMARY OF THE INVENTION

In view of the foregoing disadvantages inherent in the known types of precious item storage containers now present in the prior art, the present invention provides an improved precious item storage container construction wherein the same can be utilized to safely store and protect substantially precious coins, medals, bars and similar pieces. As such, the general purpose of the present invention, which will be described subsequently in greater detail, is to provide a new and improved precious item storage container which has all the advantages of the prior art precious item storage containers and none of the disadvantages.

To attain this, the present invention essentially comprises a storage container which can be manufactured in an airtight manner, thereby to prevent oxidation and similar damage to items contained therein, and which utilizes separators to prevent individual pieces from touching each other. Additionally, the separators are designed to touch precious coins, or similar items, along the rims only, thereby to prevent damage to the obverse and reverse surfaces thereof. The containers are provided with secure locking arrangements to achieve the desired airtight quality and are capable of holding coins, medals, bars and similar items of various diameters and thicknesses. In the case of round items, the containers are designed to prevent rolling when loaded and are also capable of absorbing substantial shocks without occurring damage to the pieces contained therein.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out it various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved precious item storage containers which has all the advantages of the prior art precious item storage containers and none of the disadvantages.

It is another object of the present invention to provide a new and improved precious item storage containers which may be easily and efficiently manufactured and marketed.

It is a further object of the present invention to provide a new and improved precious item storage containers which is of a durable and reliable construction.

An even further object of the present invention is to provide a new and improved precious item storage containers which is susceptible of a low cost of manufacture with regard to both materials and labor, and which accordingly is then susceptible of low prices of sale to the consuming public, thereby making such precious item storage containers economically available to the buying public.

Still yet another object of the present invention is to provide a new and improved precious item storage containers which provides in the apparatuses and methods of the prior art some of the advantages thereof, while simultaneously overcoming some of the disadvantages normally associated therewith.

Still another object of the present invention is to provide a new and improved precious item storage container which is particularly designed for the protective storing of a plurality of precious pieces in a manner which prevents their touching each other.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a prior art coin storage container.

FIG. 4 is a top plan view of the invention showing the same in an open configuration.

FIG. 7 is an end elevation view of the invention.

FIG. 10 is a top plan view of the sealing strip associated with the invention.

FIG. 12 is a side elevation view of the sealing strip.

DESCRIPTION OF THE PREFERRED EMBODIMENT

Figure 2:
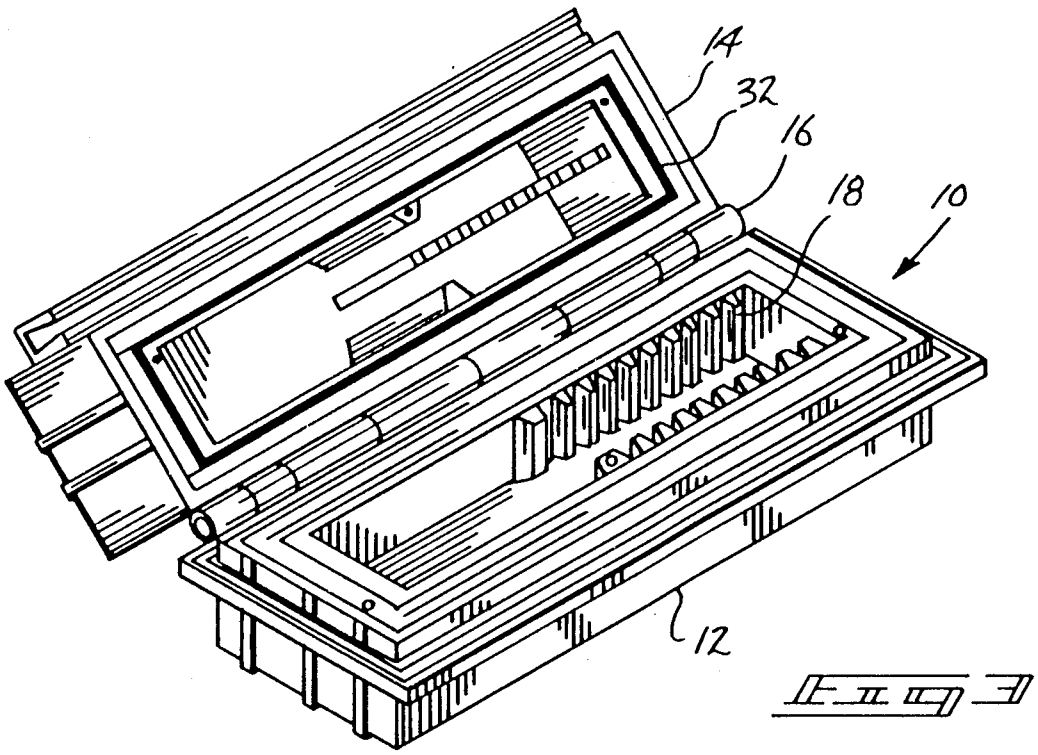
FIG. 2 is a perspective of view another prior art coin storage container.

With reference now to the drawings, a new and improved storage container for precious coins, medals, bars and the like embodying the principals and concepts of the present invention and generally designated by the reference numeral 10 will be described.

Initially, reference is made to FIGS. 1 and 2 of the drawings wherein typical prior art coin storage containers are illustrated. These prior art coin storage containers are similar in appearance to the container comprising the present invention; however, they are replete with deficiencies which would defeat the intent and purpose of the invention at issue.

For example, FIG. 1 illustrates a transparent container for holding a predetermined quantity of coins particularly described in U.S. Pat. No. 4,183,432. This coin holder includes two open-faced receptacles which are interconnected along a common edge, thereby to define a substantially cylindrical storage container. This container is not particularly well adapted for protectively storing precious medals, coins, and the like since no provision is made to prevent the precious items from coming into frictional, damaging contact with each other.

A slightly modified coin holder is shown in FIG. 2 which is more completely described in U.S. Pat. No. 4,541,528. The hinged coin holder shown in this figure is formed from two semicircular parts hinged together along one edge thereof, while some coin separators are positioned interiorly of the container. However, as shown in the drawing, the separators still do not operate to protectively secure precious items in a manner which would prevent their frictional contact which could thus result in substantial damage thereto.

Figure 3:
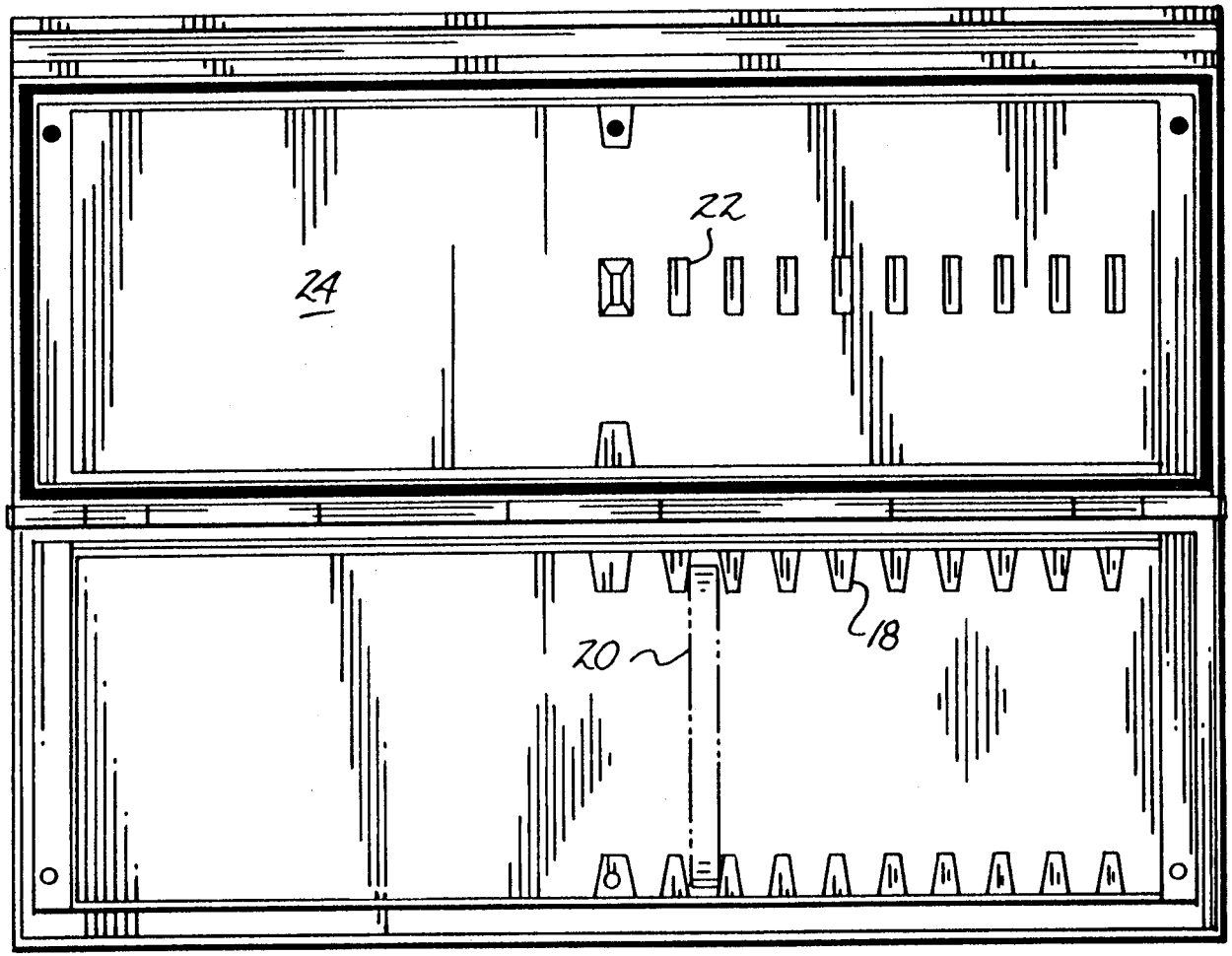
FIG. 3 is a perspective view of the storage container comprising the present invention.
Figure 5:
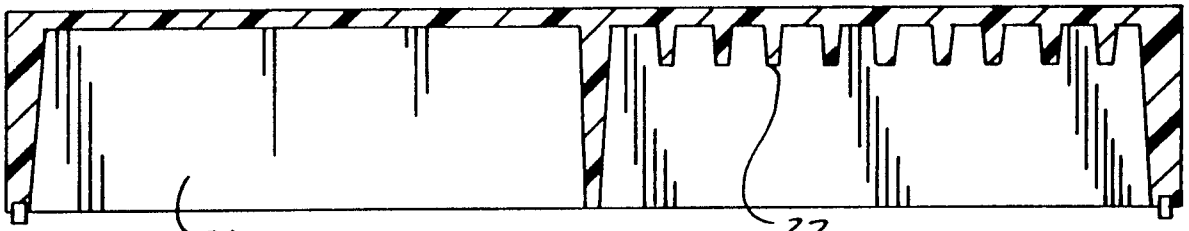
FIG. 5 is a cross-sectional view of the lid portion of the invention.
Figure 6:
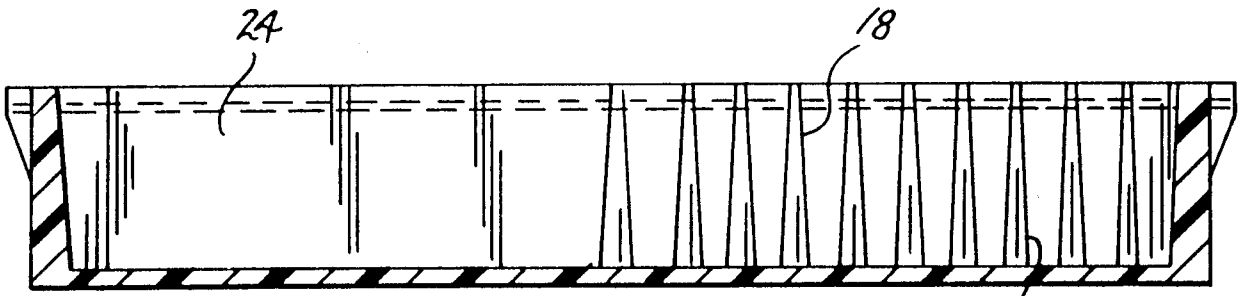
FIG. 6 is a cross-sectional view of the bottom storage container portion of the invention.

These problems are overcome by the storage container 10 specifically illustrated in FIG. 3. Referring to FIGS. 4, 5 and 6 in conjunction with FIG. 3, it will be observed that the storage container 10 essentially consists of a lower container portion 12 and a lid assembly 14 interconnected together by a hinge assembly 16. The hinge 16 may be separately constructed and attached to the container halves 12, 14, or alternatively, the entire assembly could be formed by a plastic mold injection process whereby the hinge 16 would be integrally, flexibly attached to the halves. In this respect, plastic mold injection is the preferred manner of construction for the present invention and preferably, polypropylene would be the preferred plastic used in the process.

With continuing reference to FIGS. 3, 4, 5 and 6, it can be seen that the lower section 12 of the container 10 includes a plurality of integral separators 18 disposed on opposed sides of the lower container section. Viewing the separators 18 in the top plan view shown in FIG. 4, it will be seen that the separators are of a trapezoidal shape with the intent being to store precious coins 20 between the separators in the manner illustrated with reference to the prior art container shown in FIG. 2.

As can be appreciated, the truncated shape maintained along the axial length of the separators 18 facilitates the retention of a precious coin 20 within the separators in a manner whereby only a circumferential edge portion of a coin comes into direct point contact with the separators per se. This is contrary to the construction of the prior art storage container shown in FIG. 2 wherein it can be seen that a particular separator comes into frictional engagement with a facial surface of a coin positioned thereagainst.

To further facilitate the securing of a precious coin 20 within the container 10, additional integral separators 22 are formed along a center section of the topmost lid assembly 14. As is now readily apparent, the coin 20 depicted in FIG. 4 would also come into edgewise engagement with the separators 22 when the lid 14 is closed.

The versatility of the container 10 is further illustrated in the Figures wherein it can be seen that the separators 18, 22 would normally extend over perhaps one half of the interior container compartment so that an unobstructed section 24 is defined by the mating of the container halves 12, 14. This latter section 24 facilitates the protective storage of precious medals, bars, and other items which don't fit between the separators 18, 22.

Figure 8:
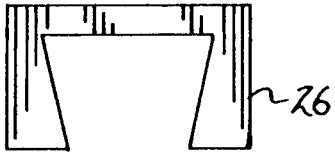
FIG. 8 is an end elevation view of the locking strip associated with the invention.
Figure 9:
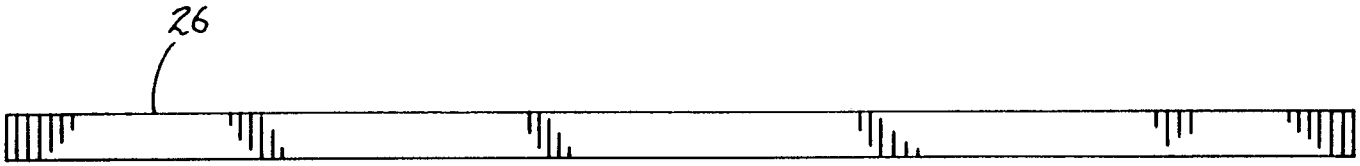
FIG. 9 is a top plan view of the locking strip comprising a part of the present invention.
Figure 11:
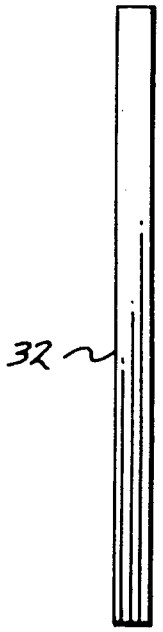
Figure 11A:
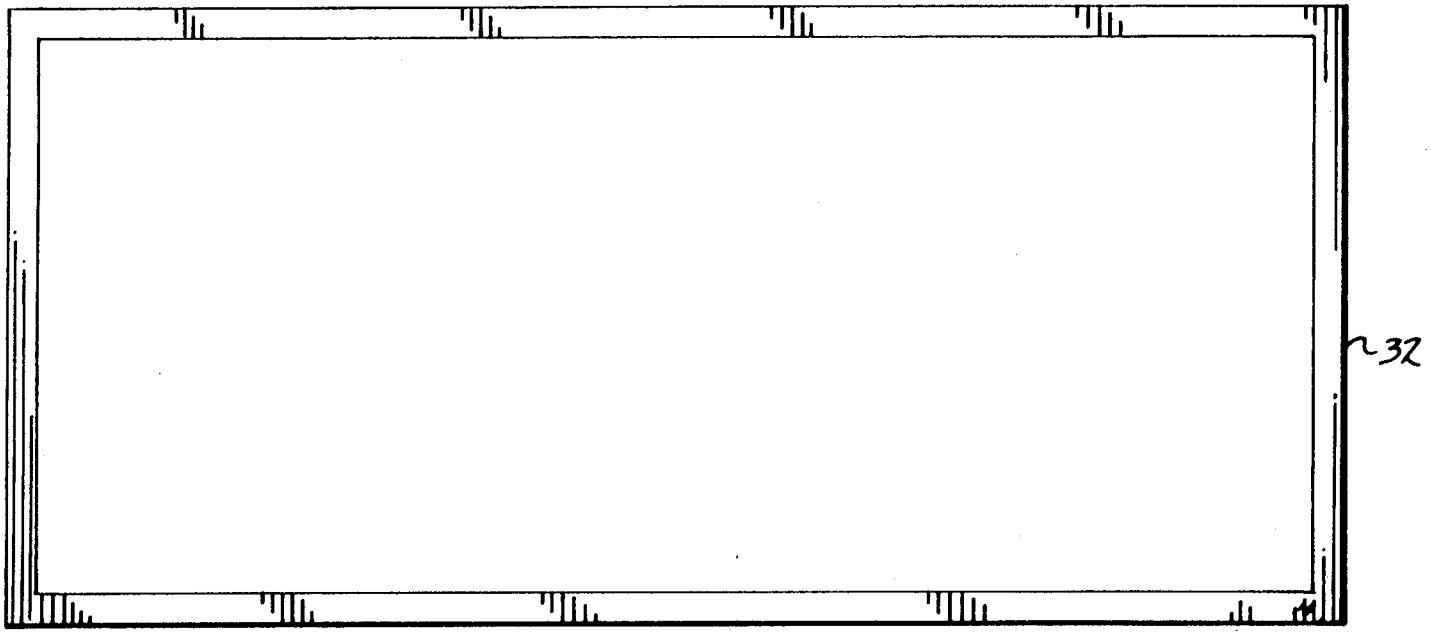
Figure 11B:
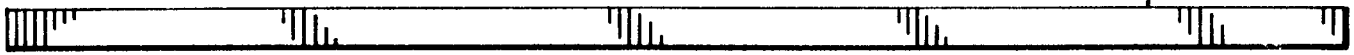

FIG. 7, 8 and 9 illustrate the locking arrangement utilized in conjunction with the container 10. More particularly, an elongated locking strip 26 is provided with an axially aligned trapezoidally-shaped slot which operates to hold the container halves 12, 14 in secure engagement when the container is in a closed configuration. In this regard, the container half 14 is provided with a forwardly positioned integral, trapezoidally-shaped lip 28, while the lower half 12 is provided with a similar integral lip 30. When the container halves 12, 14 are brought into engagement with each other, the two lips 28, 30 define a trapezoidal shape which is substantially similar to and positionable within the axial slot formed in the locking strip 26. To effect a locked engagement of the halves 12, 14 together then, the locking strip 26 may be flexibly slid into engagement with the edges 28, 30 in the manner best illustrated in FIG. 7. With the locking strip 26 in position, the container 10 is prevented from coming open whereby the precious items contained therein could spill out and be damaged or lost.

Figure 11:
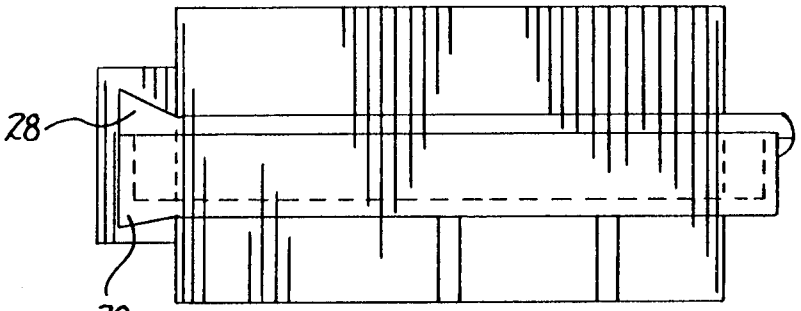
FIG. 11 is an end elevation view of the sealing strip.

A further feature of the container 10 is its ability to be sealed in an airtight manner. This feature is important when dealing with precious items inasmuch as the ambient surrounding atmosphere frequently contains many contaminants, such as acids and other substances, which can cause decay, and these air borne pollutants could materially damage a precious piece over a period of time. To guarantee the airtight quality of the container 10, reference is made to FIGS. 10, 11 and 12 of the drawings wherein a flexible, rectangularly-shaped rubber seal or gasket 32 is illustrated. The gasket 32 is shown in position on the container 10 in FIG. 3, and this seal operates to achieve the above-described airtightness of the container when the locking strip 26 is in locking engagement therewith.

As to the manner of usage and operation of the present invention, the same should be apparent from the above description. Accordingly, no further discussion relating to the manner of usage and operation will be provided.

In summary, it can be appreciated that the present invention essentially comprises a storage and shipping container which can be easily constructed of a tough and rugged plastic, such a polypropylene, and which can be manufactured by known techniques, to include injection molding. The container essentially prevents precious coins and the like from touching each other when they are stored therein, while each precious piece is positionable within the container in such a manner as to prevent the obverse and reverse surfaces thereof from touching the integral separators except along the rims thereof. The container is constructed for easy loading and unloading and provides a user with an accurate coin/medal/bar accountability. The container is capable of handling coins/medals/bars of various diameters and thicknesses, and includes a secure locking arrangement capable of withstanding at least a four foot drop test when fully loaded. The container is designed to prevent rolling when loaded or when placed on a flat surface and further facilitates easy identification as to which de thereof is open.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved storage container for precious coins, medals, bars, and other similar precious items, comprising, a bottom housing structure for receiving said precious items;

a top housing structure removably positionable on said bottom housing structure for protectively covering said precious items contained therein;

hinge means interconnecting said bottom housing structure and top housing structure; and locking means for securely positioning said top housing structure in engagement with said bottom housing structure, and wherein said locking means comprises an elongated locking strip engageable with respective edges of said bottom housing structure and said top housing structure, and wherein said elongated locking strip includes a trapezoidally-shaped slot for engaging said respective edges of said housing structure and said top housing structure, and wherein said respective edges of said bottom housing structure and said top housing structure define a trapezoidally shaped lip which is positionable within the trapezoidally shaped slot formed in said elongated locking strip, and further including integral separators positioned in said bottom housing structure, said separators serving to receive and securely position said precious items within said bottom housing structure, and wherein said separators are of a trapezoidal shape whereby said precious items come into contact with said separators along one or more surface points of said precious items, thereby to prevent damage to planar surfaces associated with said precious items.

2. The new and improved storage container for precious coins, medals, bars, and other similar precious items as described in claim 1 and including further separators integrally attached to and formed within said top housing structure, said further separators also serving to protectively engage and secure precious items within said container.

3. The new and improved storage container for precious coins, medals, bars, and other similar precious items as described in claim 2 and further including sealing means, said sealing means serving to maintain an airtight atmosphere within said container when said bottom housing structure and said top housing structure are in locked engagement as defined by a use of said elongated locking strip.

* * * * *